US009037038B2

(12) United States Patent
Karasawa et al.

(10) Patent No.: US 9,037,038 B2
(45) Date of Patent: May 19, 2015

(54) IMAGE CARRIER SURFACE TREATMENT DEVICE, PROCESS CARTRIDGE, AND IMAGE FORMING APPARATUS

(71) Applicants: Shinya Karasawa, Kanagawa (JP); Takeshi Shintani, Kanagawa (JP); Kenji Honjoh, Kanagawa (JP); Hiroyuki Uenishi, Kanagawa (JP); Daisuke Tomita, Kanagawa (JP); Norio Kudo, Kanagawa (JP); Kohsuke Yamamoto, Kanagawa (JP)

(72) Inventors: Shinya Karasawa, Kanagawa (JP); Takeshi Shintani, Kanagawa (JP); Kenji Honjoh, Kanagawa (JP); Hiroyuki Uenishi, Kanagawa (JP); Daisuke Tomita, Kanagawa (JP); Norio Kudo, Kanagawa (JP); Kohsuke Yamamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/912,303

(22) Filed: Jun. 7, 2013

(65) Prior Publication Data

US 2014/0010572 A1 Jan. 9, 2014

(30) Foreign Application Priority Data

Jul. 5, 2012 (JP) ..... 2012-151891

(51) Int. Cl.
*G03G 21/16* (2006.01)
*G03G 21/00* (2006.01)

(52) U.S. Cl.
CPC ..... *G03G 21/00* (2013.01); *G03G 21/0094* (2013.01)

(58) Field of Classification Search
USPC ..... 399/107, 111, 117, 123, 127, 346
See application file for complete search history.

(56) References Cited

U.S. PATENT DOCUMENTS

| | | | | |
|---|---|---|---|---|
| 3,490,843 | A * | 1/1970 | Charlap et al. | 399/76 |
| 7,477,862 | B2 * | 1/2009 | Takaya et al. | 399/100 |
| 7,680,429 | B2 * | 3/2010 | Takaya et al. | 399/100 |
| 2006/0039726 | A1 | 2/2006 | Shintani et al. | 399/346 |
| 2007/0036595 | A1 | 2/2007 | Amemiya et al. | 399/346 |
| 2007/0059035 | A1 | 3/2007 | Yoshino et al. | 399/111 |
| 2007/0059067 | A1 | 3/2007 | Tanaka et al. | 399/346 |
| 2007/0071525 | A1 | 3/2007 | Yoshino et al. | 399/346 |
| 2007/0154246 | A1 | 7/2007 | Shintani et al. | 399/346 |
| 2008/0069614 | A1 | 3/2008 | Shintani et al. | 399/346 |
| 2009/0185842 | A1 | 7/2009 | Hatori et al. | 399/346 |
| 2010/0021205 | A1 | 1/2010 | Honjoh et al. | 399/123 |
| 2010/0183349 | A1 | 7/2010 | Shintani et al. | 399/346 |
| 2010/0316422 | A1 | 12/2010 | Amemiya et al. | 399/346 |
| 2011/0076075 | A1 | 3/2011 | Arai et al. | 399/346 |
| 2011/0123239 | A1 | 5/2011 | Azeyanagi et al. | 399/346 |
| 2011/0170908 | A1 | 7/2011 | Saitoh et al. | 399/127 |
| 2011/0217101 | A1 * | 9/2011 | Okamoto et al. | 399/346 |
| 2012/0051782 | A1 * | 3/2012 | Gyoutoku | 399/119 |
| 2012/0155891 | A1 * | 6/2012 | Isobe | 399/12 |
| 2012/0195661 | A1 | 8/2012 | Karasawa et al. | 399/346 |

FOREIGN PATENT DOCUMENTS

| | | |
|---|---|---|
| JP | 2006-145774 | 6/2006 |
| JP | 2007-140391 | 6/2007 |

* cited by examiner

*Primary Examiner* — Clayton E Laballe
*Assistant Examiner* — Warren K Fenwick
(74) *Attorney, Agent, or Firm* — Harness, Dickey & Pierce

(57) ABSTRACT

An image carrier surface treatment device is disposed opposite an image carrier rotatable in a first rotation direction and carrying a toner image. The image carrier surface treatment device includes a roller rotatable in a second rotation direction while contacting an outer circumferential surface of the image carrier. The roller includes a shaft projecting from each lateral end of the roller in an axial direction thereof. A rolling-element bearing is fitted on the shaft of the roller to support and position the roller inside the image carrier surface treatment device.

13 Claims, 3 Drawing Sheets

IMAGE CARRIER SURFACE TREATMENT DEVICE, PROCESS CARTRIDGE, AND IMAGE FORMING APPARATUS

CROSS-REFERENCE TO RELATED APPLICATION

This patent application is based on and claims priority pursuant to 35 U.S.C. §119 to Japanese Patent Application No. 2012-151891, filed on Jul. 5, 2012, in the Japanese Patent Office, the entire disclosure of which is hereby incorporated by reference herein.

BACKGROUND

1. Field

Example embodiments generally relate to an image carrier surface treatment device, a process cartridge, and an image forming apparatus, and more particularly, to an image carrier surface treatment device for performing surface treatment of an image carrier and a process cartridge and an image forming apparatus incorporating the image carrier surface treatment device.

2. Discussion of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductive drum serving as an image carrier rotatable in a given direction of rotation; an optical writer emits a light beam onto the charged surface of the photoconductive drum to form an electrostatic latent image on the photoconductive drum according to the image data; a development device supplies toner to the electrostatic latent image formed on the photoconductive drum to render the electrostatic latent image visible as a toner image; the toner image is directly transferred from the photoconductive drum onto a recording medium or is indirectly transferred from the photoconductive drum onto a recording medium via an intermediate transfer belt; finally, a fixing device applies heat and pressure to the recording medium bearing the toner image to fix the toner image on the recording medium, thus forming the image on the recording medium.

Such image forming apparatuses may further include a cleaning blade that removes residual toner failed to be transferred onto the intermediate transfer belt or a recording medium and therefore remaining on the photoconductive drum therefrom and a lubricant supplier that supplies a lubricant onto the photoconductive drum to decrease friction between the photoconductive drum and the cleaning blade sliding thereover, thus reducing abrasion of the photoconductive drum and the cleaning blade.

For example, the lubricant supplier may be disposed downstream from the cleaning blade in the direction of rotation of the photoconductive drum and include a lubricant application roller that rotates in a given direction of rotation and slides over the photoconductive drum; a solid lubricant in contact with the lubricant application roller; a spring that biases the solid lubricant against the lubricant application roller; and a level blade disposed downstream from the lubricant application roller in the direction of rotation of the photoconductive drum and in contact with the photoconductive drum. As the lubricant application roller slides over the solid lubricant and the photoconductive drum, it scrapes a lubricant off the solid lubricant and applies the scraped lubricant onto the photoconductive drum. Thereafter, the level blade levels the lubricant applied on the photoconductive drum into a thin layer.

As the lubricant application roller rotating in the given direction of rotation slides over both the solid lubricant and the photoconductive drum, the lubricant application roller may create vibration. If the vibration is transmitted to the photoconductive drum abutting the lubricant application roller, the toner image formed on the photoconductive drum may be degraded into a faulty toner image such as a streaky toner image produced by periodical vibration of the photoconductive drum.

SUMMARY

At least one embodiment may provide an image carrier surface treatment device disposed opposite an image carrier rotatable in a first rotation direction and carrying a toner image. The image carrier surface treatment device includes a roller rotatable in a second rotation direction while contacting an outer circumferential surface of the image carrier. The roller includes a shaft projecting from each lateral end of the roller in an axial direction thereof. A rolling-element bearing is fitted on the shaft of the roller to support and position the roller inside the image carrier surface treatment device.

At least one embodiment may provide a process cartridge detachably attachable to an image forming apparatus and including an image carrier rotatable in a first rotation direction and carrying a toner image. The process cartridge further includes an image carrier surface treatment device disposed opposite the image carrier and including a roller rotatable in a second rotation direction while contacting an outer circumferential surface of the image carrier. The roller includes a shaft projecting from each lateral end of the roller in an axial direction thereof. A rolling-element bearing is fitted on the shaft of the roller to support and position the roller inside the image carrier surface treatment device.

At least one embodiment may provide an image forming apparatus that includes an image carrier rotatable in a first rotation direction to carry a toner image and an image carrier surface treatment device disposed opposite the image carrier and including a roller rotatable in a second rotation direction while contacting an outer circumferential surface of the image carrier. The roller includes a shaft projecting from each lateral end of the roller in an axial direction thereof. A rolling-element bearing is fitted on the shaft of the roller to support and position the roller inside the image carrier surface treatment device.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
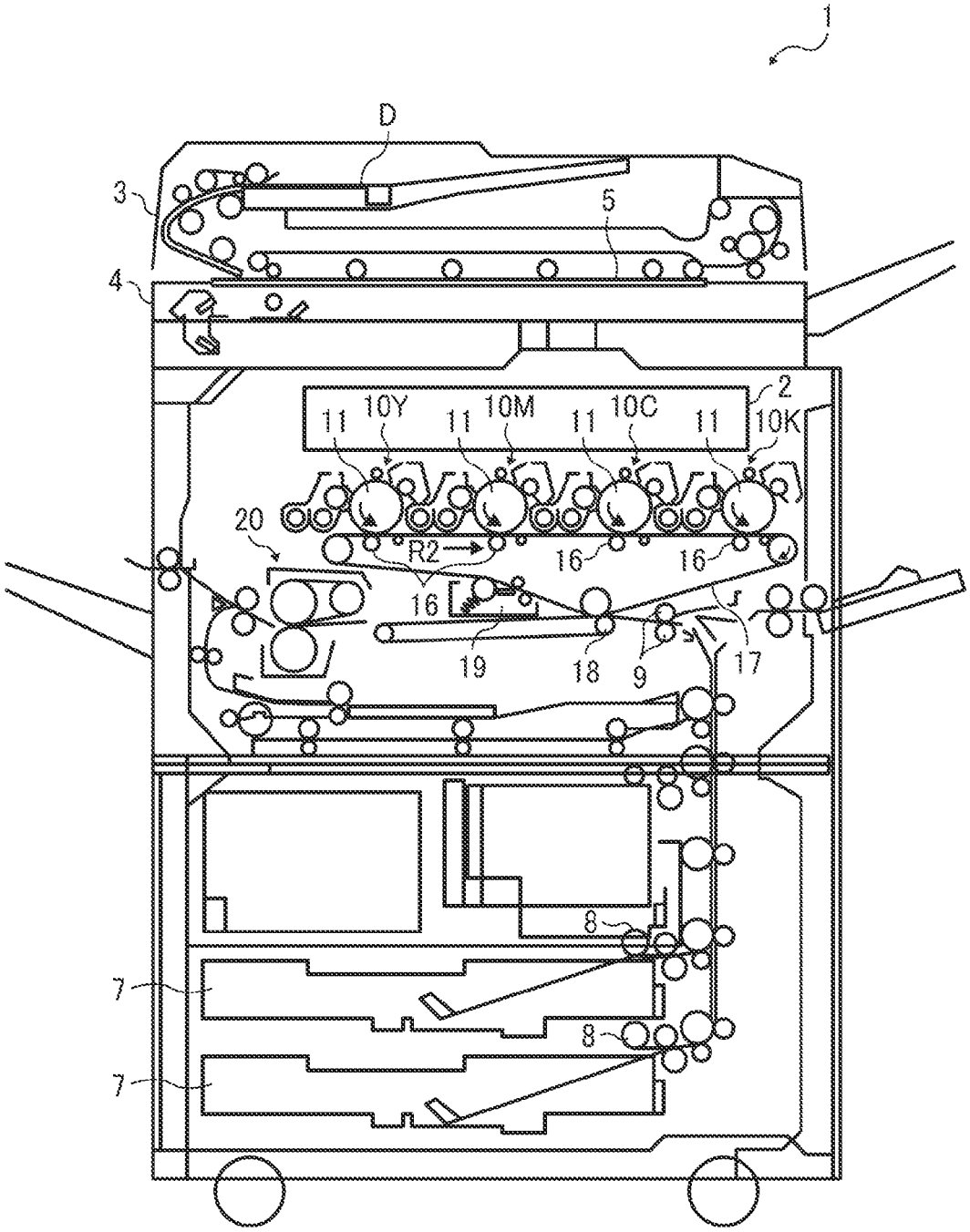
FIG. 1 is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic vertical sectional view of the image forming apparatus 1. The image forming apparatus 1 may be a copier, a facsimile machine, a printer, a multifunction printer (MFP) having at least one of copying, printing, scanning, plotter, and facsimile functions, or the like. According to this example embodiment, the image forming apparatus 1 is a tandem color copier that forms color and monochrome images on recording media by electrophotography.

Figure 2:
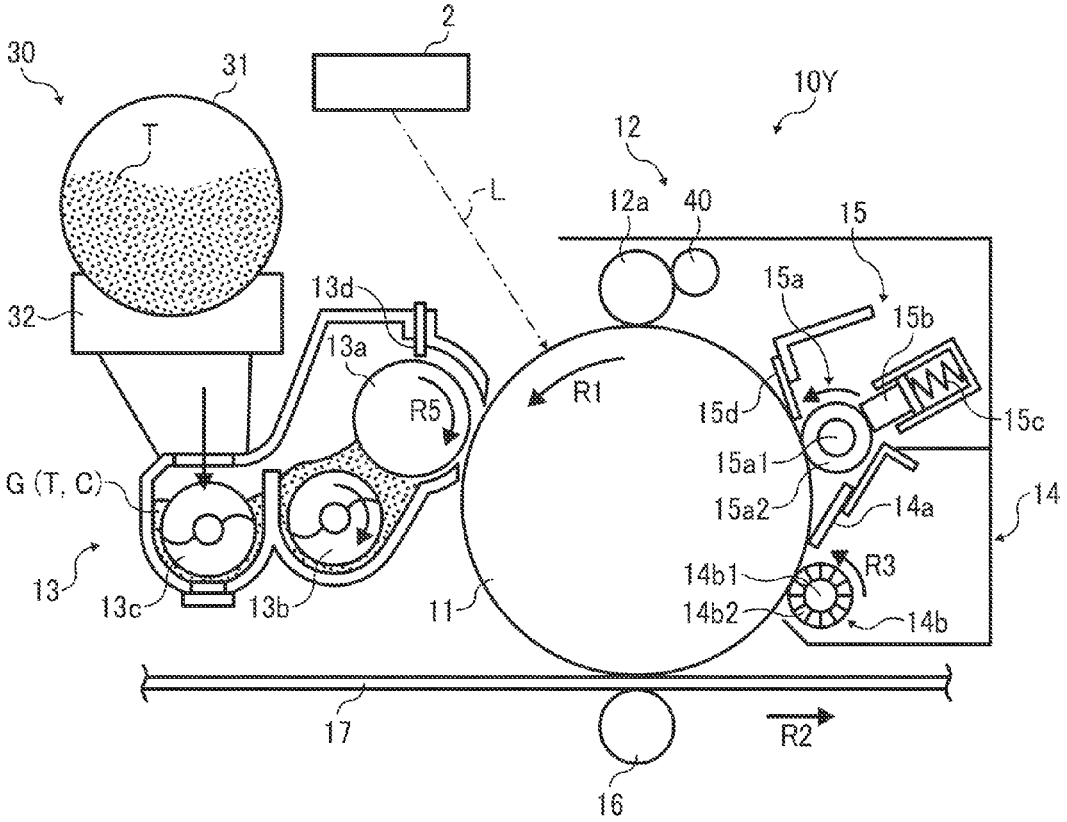
FIG. 2 is a vertical sectional view of a process cartridge incorporated in the image forming apparatus shown in FIG. 1.

FIG. 2 is a vertical sectional view of a process cartridge 10Y incorporated in the image forming apparatus 1 shown in FIG. 1, that forms a yellow toner image. As shown in FIG. 1, the image forming apparatus 1 includes four process cartridges 10Y, 10M, 10C, and 10K serving as image forming devices that form toner images in different colors, that is, yellow, magenta, cyan, and black toner images, respectively. However, each of the process cartridges 10M, 10C, and 10K has a construction equivalent to that of the process cartridge 10Y. Hence, illustration and description of the construction of the process cartridges 10M, 10C, and 10K are omitted.

An auto document feeder (ADF) 3 disposed atop the image forming apparatus 1 feeds an original D to a reader 4 situated below the ADF 3. The reader 4 reads an image on the original D into image data. A writer 2 disposed below the reader 4 emits laser beams onto four photoconductive drums 11 of the four process cartridges 10Y, 10M, 10C, and 10K according to the image data sent from the reader 4, thus forming electrostatic latent images on the photoconductive drums 11. The process cartridges 10Y, 10M, 10C, and 10K situated below the writer 2 visualize the electrostatic latent images into yellow, magenta, cyan, and black toner images, respectively. Four primary transfer rollers 16 disposed opposite the photoconductive drums 11 primarily transfer the yellow, magenta, cyan, and black toner images formed on the photoconductive drums 11 onto an intermediate transfer belt 17 such that the yellow, magenta, cyan, and black toner images are superimposed on a same position on the intermediate transfer belt 17, thus forming a color toner image thereon.

A plurality of paper trays 7 situated in a lower portion of the image forming apparatus 1 loads a plurality of recording media (e.g., transfer sheets). A feed roller 8 rotatably mounted on the respective paper trays 7 feeds a recording medium toward a registration roller pair 9. As the registration roller pair 9 feeds the recording medium to a secondary transfer roller 18 disposed opposite the intermediate transfer belt 17, the secondary transfer roller 18 secondarily transfers the color toner image formed on the intermediate transfer belt 17 onto the recording medium. An intermediate transfer belt cleaner 19 disposed opposite the intermediate transfer belt 17 cleans the intermediate transfer belt 17. A fixing device 20 disposed downstream from the secondary transfer roller 18 in a recording medium conveyance direction fixes the color toner image on the recording medium.

A description is provided of an image forming operation performed by the image forming apparatus 1 described above to form a color toner image.

Conveyance rollers of the ADF 3 feed an original D placed on an original tray to an exposure glass 5 of the reader 4. Alternatively, a user may place an original D on the exposure glass 5. The reader 4 optically reads an image on the original D through the exposure glass 5. For example, a lamp of the reader 4 emits light onto the image on the original D through the exposure glass 5 such that the light scans the image on the original D. The light reflected by the original D travels through a plurality of mirrors and a lens into a color sensor that forms an image. The color sensor reads the image into image data corresponding to separation colors, that is, red, green, and blue, which is converted into an electric signal. Further, based on the electric signal corresponding to red, green, and blue, an image processor performs processing such as color conversion processing, color correction processing, and space frequency correction processing, thus producing yellow, magenta, cyan, and black image data.

The yellow, magenta, cyan, and black image data created by the reader 4 is sent to the writer 2. The writer 2 emits laser beams (e.g., exposure light) onto the photoconductive drums 11 of the process cartridges 10Y, 10M, 10C, and 10K according to the yellow, magenta, cyan, and black image data, respectively, forming electrostatic latent images thereon. Thus, each of the photoconductive drums 11 serves as an image carrier for carrying an electrostatic latent image.

With reference to FIG. 2, taking the photoconductive drum 11 of the process cartridge 10Y, a detailed description is now given of image forming processes performed on the photoconductive drum 11 of the respective process cartridges 10Y, 10M, 10C, and 10K depicted in FIG. 1.

As shown in FIG. 2, the photoconductive drum 11 rotates counterclockwise in a rotation direction R1. In a charging process, a charging roller 12*a* of a charger 12 disposed opposite the photoconductive drum 11 uniformly charges an outer circumferential surface of the photoconductive drum 11. Thus, the photoconductive drum 11 bears a charging potential.

In an exposure process, as the charged outer circumferential surface of the photoconductive drum 11 reaches an irradiation position where the writer 2 is disposed opposite the photoconductive drum 11, a light source of the writer 2 emits a laser beam L onto the charged outer circumferential surface of the photoconductive drum 11 according to an electric signal corresponding to yellow image data. Other three light sources of the writer 2 emit laser beams L onto the photoconductive drums 11 of the process cartridges 10M, 10C, and 10K according to electric signals corresponding to magenta, cyan, and black image data, respectively. The laser beams L travel through different optical paths that lead to the photoconductive drums 11 of the process cartridges 10Y, 10M, 10C, and 10K, respectively.

As shown in FIG. 1, the writer 2 emits a laser beam L onto the leftmost photoconductive drum 11 of the process cartridge 10Y according to the yellow image data. For example, a polygon mirror rotating at high speed directs the laser beam L to scan the photoconductive drum 11 in a main scanning direction parallel to an axial direction of the photoconductive drum 11. Thus, an electrostatic latent image corresponding to the yellow image data is formed on the outer circumferential surface of the photoconductive drum 11 of the process cartridge 10Y that is charged by the charging roller 12*a*.

Similarly, the writer 2 emits a laser beam L onto the second photoconductive drum 11 from the left in FIG. 1 of the process cartridge 10M according to the magenta image data, thus forming an electrostatic latent image corresponding to the magenta image data on the photoconductive drum 11. The writer 2 emits a laser beam L onto the third photoconductive drum 11 from the left in FIG. 1 of the process cartridge 10C according to the cyan image data, thus forming an electrostatic latent image corresponding to the cyan image data on the photoconductive drum 11. The writer 2 emits a laser beam L onto the rightmost photoconductive drum 11 in FIG. 1 of the process cartridge 10K according to the black image data, thus forming an electrostatic latent image corresponding to the black image data on the photoconductive drum 11.

As shown in FIG. 2, in a development process, as the electrostatic latent image formed on the photoconductive drum 11 reaches a development position where a development device 13 is disposed opposite the photoconductive drum 11, the development device 13 supplies yellow toner to the electrostatic latent image formed on the photoconductive drum 11, thus developing the electrostatic latent image into a yellow toner image. Thus, the photoconductive drum 11 serves as an image carrier for carrying a toner image. Thereafter, the yellow toner image formed on the photoconductive drum 11 reaches a primary transfer position where the primary transfer roller 16 in contact with an inner circumferential surface of the intermediate transfer belt 17 is disposed opposite the photoconductive drum 11 via the intermediate transfer belt 17. In a primary transfer process, the primary transfer roller 16 primarily transfers the yellow toner image formed on the photoconductive drum 11 onto an outer circumferential surface of the intermediate transfer belt 17.

Similarly, the development devices 13 of the process cartridges 10M, 10C, and 10K depicted in FIG. 1 develop the electrostatic latent images formed on the photoconductive drums 11 into magenta, cyan, and black toner images, respectively. Thus, as the intermediate transfer belt 17 rotates in a rotation direction R2, the yellow, magenta, cyan, and black toner images formed on the photoconductive drums 11 of the process cartridges 10Y, 10M, 10C, and 10K are primarily transferred onto a same position on the intermediate transfer belt 17 successively, thus forming a color toner image on the intermediate transfer belt 17.

As shown in FIG. 2, after the primary transfer process, the outer circumferential surface of the photoconductive drum 11 reaches a cleaning position where a cleaner 14 serving as an image carrier surface treatment device is disposed opposite the photoconductive drum 11. The cleaner 14 includes a cleaning blade 14*a* serving as a blade and a cleaning roller 14*b* serving as a roller. At the cleaning position, the cleaning blade 14*a* and the cleaning roller 14*b* mechanically remove residual toner failed to be transferred onto the intermediate transfer belt 17 and therefore remaining on the photoconductive drum 11 therefrom in a cleaning process. The removed toner is collected into the cleaner 14 as waste toner.

Thereafter, as the outer circumferential surface of the photoconductive drum 11 passes through a lubrication position where a lubricant supplier 15 is disposed opposite the photoconductive drum 11, the lubricant supplier 15 serving as an image carrier surface treatment device supplies a lubricant to the outer circumferential surface of the photoconductive drum 11. Thereafter, as the outer circumferential surface of the photoconductive drum 11 passes through a discharging position where a discharger is disposed opposite the photoconductive drum 11, the discharger discharges the outer circumferential surface of the photoconductive drum 11. Thus, a series of image forming processes performed on the photoconductive drum 11 is completed.

On the other hand, as shown in FIG. 1, as the intermediate transfer belt 17 bearing the color toner image rotates clockwise in the rotation direction R2, the intermediate transfer belt 17 reaches a secondary transfer position where the secondary transfer roller 18 is disposed opposite the intermediate transfer belt 17. At the secondary transfer position, the secondary transfer roller 18 secondarily transfers the color toner image formed on the intermediate transfer belt 17 onto a recording medium conveyed from one of the paper trays 7 in a secondary transfer process.

At a cleaning position where the intermediate transfer belt cleaner 19 is disposed opposite the intermediate transfer belt 17, the intermediate transfer belt cleaner 19 removes residual toner failed to be transferred onto the recording medium and therefore remaining on the intermediate transfer belt 17 therefrom. The removed toner is collected into the intermediate transfer belt cleaner 19. Thus, a series of transfer processes, that is, the primary transfer process and the secondary transfer process, performed on the intermediate transfer belt 17 is completed.

The recording medium is conveyed from one of the paper trays 7 to a secondary transfer nip formed between the intermediate transfer belt 17 and the secondary transfer roller 18 through the registration roller pair 9. For example, the recording medium loaded in the paper tray 7 is picked up and conveyed by the feed roller 8 through a conveyance guide to the registration roller pair 9 (e.g., a timing roller pair). The registration roller pair 9 conveys the recording medium to the secondary transfer nip at a time when the color toner image formed on the intermediate transfer belt 17 reaches the secondary transfer nip.

The recording medium bearing the color toner image is guided by a conveyance belt to the fixing device 20. The fixing device 20 includes a fixing belt and a pressing roller pressed against the fixing belt to form a fixing nip therebetween where the color toner image is fixed on the recording medium. Thereafter, the recording medium bearing the fixed color toner image is discharged by an output roller pair onto an outside of the image forming apparatus 1. Thus, a series of image forming processes performed by the image forming apparatus 1 is completed.

With reference to FIG. 2, a description is provided of a construction of the process cartridge 10Y.

As shown in FIG. 2, the process cartridge 10Y includes the photoconductive drum 11, the charger 12 incorporating the charging roller 12*a*, the development device 13, the cleaner 14, and the lubricant supplier 15, which constitute a unit.

A detailed description is now given of a construction of the photoconductive drum 11.

The photoconductive drum 11 is a negatively charged, organic photoconductor or photoreceptor. The photoconductive drum 11 includes a drum-shaped conductive support and a photosensitive layer mounted thereon. For example, the photoconductive drum 11 is constructed of a base layer serving as the conductive support; an insulating layer serving as an underlying layer; a charge generation layer or a charge transport layer serving as the photosensitive layer; and a protective layer serving as a surface layer, which are layered in this order.

A detailed description is now given of a construction of the charger 12.

The charger 12 includes the charging roller 12*a* and a charger cleaning roller 40. The charging roller 12*a* is constructed of a conductive metal core and an elastic layer coating an outer circumference of the metal core and having a medium resistance. As a power supply applies a given voltage, that is, a superimposed voltage of an alternating current voltage and a direct current voltage, to the charging roller 12*a*, the charging roller 12*a* uniformly charges the outer circumferential surface of the photoconductive drum 11 disposed opposite the charging roller 12*a*. According to this example embodiment, a compression spring biases the charging roller 12*a* against the photoconductive drum 11, bringing the charging roller 12*a* into contact with the photoconductive drum 11 with pressure therebetween. Alternatively, the charging roller 12*a* may be disposed opposite the photoconductive drum 11 with a slight interval therebetween without contacting the photoconductive drum 11. The charger cleaning roller 40 pressingly contacting the charging roller 12*a* cleans an outer circumferential surface of the charging roller 12*a*.

A detailed description is now given of a construction of the development device 13.

The development device 13 is constructed of a development roller 13*a* disposed opposite the photoconductive drum 11; a primary conveyance screw 13*b* disposed opposite the development roller 13*a*; a secondary conveyance screw 13*c* disposed opposite the primary conveyance screw 13*b* via a partition; and a doctor blade 13*d* disposed opposite the development roller 13*a*. The development roller 13*a* is constructed of a magnet fixedly provided inside the development roller 13*a* to create a magnetic pole on a circumferential surface of the development roller 13*a* and a sleeve rotatable around the magnet. As the magnet creates a plurality of magnetic poles on the sleeve of the development roller 13*a*, the development roller 13*a* bears a developer G.

The development device 13 contains the two-component developer G containing carrier particles C and toner particles T, that is, toner. The toner particle T is a spherical particle having a roundness of about 0.93 or more and a ratio between a weight mean diameter D4 and a number mean diameter D1 (D4/D1) in a range of from about 1.00 to about 1.40. The roundness of the toner particle T defines a circumferential length of a circle having an area identical to an area of a projected particle with respect to a circumferential length of a projected particle image. The roundness of the toner particles T is calculated based on a value measured with a flow particle image analyzer FPIA-2000 manufactured by Sysmex Corporation. The weight mean diameter D4 and the number mean diameter D1 of the toner particle T are measured with a particle diameter measurement device SD2000 manufactured by Hosokawa Micron Corporation.

A detailed description is now given of a construction of the cleaner 14.

The cleaner 14 includes the cleaning blade 14*a* serving as a blade for cleaning the outer circumferential surface of the photoconductive drum 11 by contacting it and the cleaning roller 14*b* serving as a roller for cleaning the outer circumferential surface of the photoconductive drum 11 as the cleaning roller 14*b* in contact with the outer circumferential surface of the photoconductive drum 11 rotates counterclockwise in FIG. 2 in a rotation direction R3.

The cleaning blade 14*a* is made of rubber such as urethane rubber and in contact with the outer circumferential surface of the photoconductive drum 11 with a given angle and a given pressure. Thus, the cleaning blade 14*a* mechanically scrapes an adhesive substance adhered to the photoconductive drum 11 off the photoconductive drum 11 into the cleaner 14. For example, the adhesive substance may be residual toner failed to be transferred onto the intermediate transfer belt 17 and therefore remaining on the photoconductive drum 11, paper dust produced from the recording medium, a corona product carried by the photoconductive drum 11 as the charging roller 12*a* performs discharge, an additive added to the toner particles T, and the like. The cleaning blade 14*a* is directed to the photoconductive drum 11 in a direction counter to the rotation direction R1 of the photoconductive drum 11.

The cleaning roller 14*b* is a brush roller constructed of a metal shaft 14*b*1 (e.g., a metal core) and bristles 14*b*2 surrounding the shaft 14*b*1. As a driver drives and rotates the cleaning roller 14*b* in the rotation direction R3, the bristles 14*b*2 of the cleaning roller 14*b* slide over the outer circumferential surface of the photoconductive drum 11. Thus, the cleaning roller 14*b* mechanically scrapes residual toner off the photoconductive drum 11 into the cleaner 14. The cleaning roller 14*b* disposed upstream from the cleaning blade 14*a* in the rotation direction R1 of the photoconductive drum 11 complements the cleaning blade 14*a* to clean the photoconductive drum 11. The cleaner 14 having the construction described above serves as an image carrier surface treatment device disposed opposite the photoconductive drum 11 to perform surface treatment of the photoconductive drum 11, thus increasing the lifespan of the photoconductive drum 11.

Figure 3:
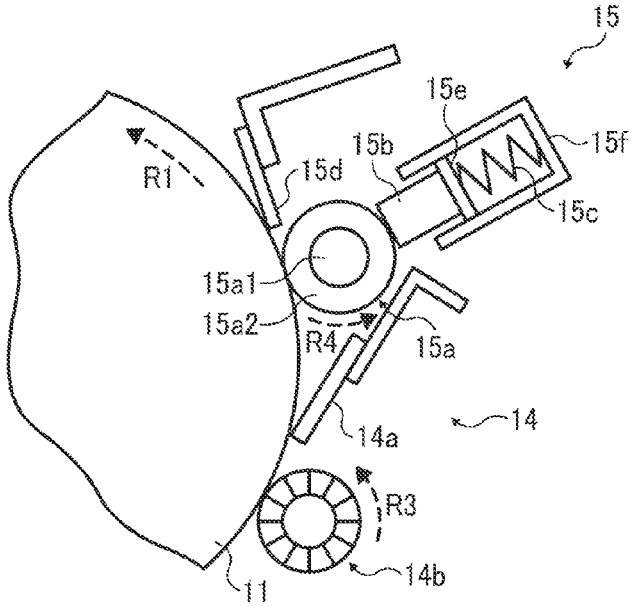
FIG. 3 is a partial vertical sectional view of a photoconductive drum, a cleaner, and a lubricant supplier incorporated in the process cartridge shown in FIG. 2.

With reference to FIGS. 2 and 3, a description is provided of a construction of the lubricant supplier 15 serving as an image carrier surface treatment device disposed opposite the photoconductive drum 11 to perform surface treatment of the photoconductive drum 11, thus increasing the lifespan of the photoconductive drum 11.

FIG. 3 is a partial vertical sectional view of the photoconductive drum 11, the cleaner 14, and the lubricant supplier 15. As shown in FIGS. 2 and 3, the lubricant supplier 15 includes a lubricant application roller 15*a*, a solid lubricant 15*b*, a compression spring 15*c*, a level blade 15*d*, a mount 15*e*, and a guide 15*f*. The lubricant application roller 15*a* serves as a roller including an elastic foam layer 15*a*2 constituting an outer circumferential layer that slides over the photoconductive drum 11 to apply a lubricant scraped off the solid lubricant 15*b* to the outer circumferential surface of the photoconductive drum 11. The elastic foam layer 15*a*2 of the lubricant application roller 15*a* slides over the solid lubricant 15*b*. The compression spring 15*c* serves as a biasing member that biases the solid lubricant 15*b* against the lubricant application roller 15*a*. The level blade 15*d* serves as a blade in contact with the photoconductive drum 11 to level the lubricant supplied on the photoconductive drum 11, thus producing a thin lubricant layer thereon. The mount 15*e* is a plate mounting the solid lubricant 15*b*. The guide 15*f* is a holder that substantially encases and guides the solid lubricant 15*b* mounted on the mount 15*e* and pressed against the lubricant application roller 15*a* by the compression spring 15*c*. The lubricant supplier 15 is disposed downstream from the cleaning blade 14*a* of the cleaner 14 and upstream from the charging roller 12*a* of the charger 12 in the rotation direction R1 of the photoconductive drum 11. The level blade 15*d* is disposed downstream from the lubricant application roller 15*a* in the rotation direction R1 of the photoconductive drum 11.

A detailed description is now given of a construction of the lubricant application roller 15*a*.

The lubricant application roller 15*a* is a roller constructed of a metal shaft 15*a*1 a metal core) and the elastic foam layer 15*a*2 coating the shaft 15*a*1 and made of polyurethane foam or urethane foam. As the elastic foam layer 15*a*2 of the lubricant application roller 15*a* in contact with the outer circumferential surface of the photoconductive drum 11 rotates counterclockwise in FIG. 3 in a rotation direction R4, the lubricant application roller 15*a* applies the lubricant scraped off the solid lubricant 15*b* to the photoconductive drum 11.

A description is provided of a method for manufacturing the lubricant application roller 15*a*.

Polyurethane foam to be produced into the elastic foam layer 15*a*2 is formed into a block. The block is cut into a primary piece having a given shape and its surface is ground. A core (e.g., a metal core) to be produced into the shaft 15*a*1 is inserted into the primary piece of polyurethane foam. As the primary piece of polyurethane foam is rotated, a grind blade in contact with the primary piece moves parallel to an axial direction of the metal core until the grind blade cuts the primary piece into a sponge having a given thickness by traverse grinding. Thus, the elastic foam layer 15*a*2 is manufactured. Before the metal core is inserted into the primary piece of polyurethane foam, an adhesive may be applied to the metal core to facilitate adhesion of the metal core to the primary piece. Further, during traverse grinding, the rotation speed of the primary piece of polyurethane foam and the moving speed of the grind blade may be changed to produce uneven surface asperities on the elastic foam layer. The method for manufacturing the lubricant application roller 15*a* is not limited to the above. For example, alternatively, a polyurethane foam material is injected into a mold accommodating the metal core and foamed and hardened.

A detailed description is now given of a configuration of the lubricant application roller 15*a*.

As shown in FIG. 3, the lubricant application roller 15*a* rotates counterclockwise in the rotation direction R4, that is, a counter direction at a contact point where the lubricant application roller 15*a* contacts the photoconductive drum 11 rotating counterclockwise in the rotation direction R1 such that the lubricant application roller 15*a* slides over the photoconductive drum 11. The lubricant application roller 15*a* slides over the solid lubricant 15*b* and the photoconductive drum 11. As the lubricant application roller 15*a* rotates in the rotation direction R4, the lubricant application roller 15*a* scrapes a lubricant off the solid lubricant 15*b* and applies the scraped lubricant onto the photoconductive drum 11. The compression spring 15*c* is disposed opposite the lubricant application roller 15*a* via the mount 15*e* and the solid lubricant 15*b*. The compression spring 15*c* is anchored to the mount 15*e* and the guide 15*f* to bias and press the solid lubricant 15*b* against the lubricant application roller 15*a*, thus bringing the solid lubricant 15*b* into even contact with the lubricant application roller 15*a*.

A detailed description is now given of a configuration of the solid lubricant 15*b*.

The solid lubricant 15*b* is made of aliphatic acid zinc metal containing an inorganic lubricant. For example, the aliphatic acid zinc metal may contain at least zinc stearate. The inorganic lubricant may contain at least one of talc, mica, and boron nitride. The zinc stearate may be typical lamella crystalline powder. Lamella crystal has a self-assembled layer structure produced with amphipathic molecule. Accordingly, as the lamella crystal receives a shear force, it may be broken along an interlayer and subject to slippage. Consequently, the lamella crystal applied on the outer circumferential surface of the photoconductive drum 11 decreases friction between the photoconductive drum 11 and a component or a substance sliding thereover. Since the lamella crystal, upon receiving a shear force, spreads over and coats the outer circumferential surface of the photoconductive drum 11 evenly, the lubricant containing the lamella crystal, even with a small amount thereof, coats the outer circumferential surface of the photoconductive drum 11 effectively. Accordingly, the lubricant coats the outer circumferential surface of the photoconductive drum 11 relatively evenly, protecting the photoconductive drum 11 against electrical stress during the charging process precisely. The inorganic lubricant having a plated structure such as talc, mica, and boron nitride prevents the toner and the lubricant from passing under the cleaning blade 14*a* and reaching and staining the charging roller 12*a*.

A description is provided of a method for manufacturing the solid lubricant 15*b*.

Dissolved powder is put into a mold and compressed, thus being solidified into a substantial prism. The method simplifies production facility, resulting in reduced manufacturing costs.

A detailed description is now given of a configuration of the level blade 15*d*.

The level blade 15*d* is a plate made of rubber such as urethane rubber and in contact with the outer circumferential surface of the photoconductive drum 11 at a given angle and a given pressure therebetween. The level blade 15*d* is disposed downstream from the cleaning blade 14*a* in the rotation direction R1 of the photoconductive drum 11. The level blade 15*d* levels the lubricant supplied from the lubricant application roller 15*a* onto the photoconductive drum 11 into a thin lubricant layer that coats the photoconductive drum 11 evenly with a proper amount. As the lubricant application roller 15*a* applies the lubricant scraped off the solid lubricant 15*b* onto the outer circumferential surface of the photoconductive drum 11, the photoconductive drum 11 bears a powdery lubricant that lubricates the photoconductive drum 11 insufficiently. To address this circumstance, the level blade 15*d* levels the powdery lubricant into the thin lubricant layer. Thus, the level blade 15*d* produces the thin lubricant layer that coats and lubricates the photoconductive drum 11. That is, the powdery lubricant that lubricates the photoconductive drum 11 insufficiently is transformed into the thin lubricant layer that lubricates the photoconductive drum 11 sufficiently.

The level blade 15*d* is directed to and brought into contact with the outer circumferential surface of the photoconductive drum 11 in a direction counter to the rotation direction R1 of the photoconductive drum 11 with a pressure in a range of from about 10 g/cm$^2$ to about 60 g/cm$^2$ and a contact angle θ in a range of from about 75 degrees to about 90 degrees. The level blade 15*d* brought into contact with the photoconductive drum 11 in the direction counter to the rotation direction R1 of the photoconductive drum 11 thins the lubricant on the photoconductive drum 11 effectively. The contact angle θ defines an angle formed between a hypothetical line passing through an edge of the level blade 15*d* abutted against and bent by the photoconductive drum 11 and a tangent to the photoconductive drum 11, that is, a line perpendicular to a normal, at an abut point where the edge of the level blade 15*d* abuts against the photoconductive drum 11.

The two separate blades, that is, the cleaning blade 14*a* and the level blade 15*d*, contact the photoconductive drum 11 to clean and lubricate the photoconductive drum 11 precisely. The lubricant supplied to the photoconductive drum 11 reduces abrasion and wear of the cleaning blade 14*a* and the level blade 15*d* caused by friction between the photoconductive drum 11 and the cleaning blade 14*a* and friction between the photoconductive drum 11 and the level blade 15*d*. A surface of an edge of the cleaning blade 14*a* and the level blade 15*d* that contacts the photoconductive drum 11 is coated with fluoroplastic, for example, to reduce friction between the cleaning blade 14*a* and the photoconductive drum 11 and between the level blade 15*d* and the photoconductive drum 11. Accordingly, frictional abrasion and wear of the cleaning blade 14*a* and the level blade 15*d* are reduced, enhancing durability of the cleaning blade 14*a* and the level blade 15*d*.

Figure 4:
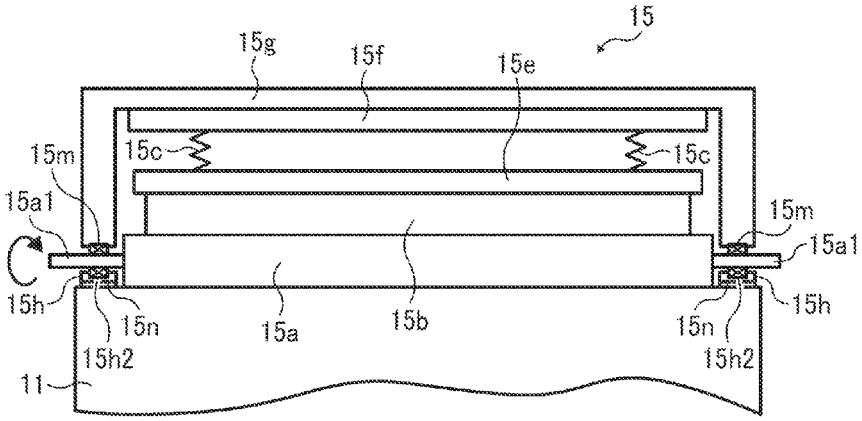
FIG. 4 is a horizontal sectional view of the lubricant supplier shown in FIG. 3.

With reference to FIGS. 3 and 4, a detailed description is now given of a configuration of the mount 15*e*, the guide 15*f*, and the compression spring 15*c*.

FIG. 4 is a horizontal sectional view of the lubricant supplier 15. As shown in FIG. 3, the mount 15*e* is a plate that mounts the solid lubricant 15*b*. For example, the solid lubricant 15*b* is attached to one face of the mount 15*e* with an adhesive. The guide 15*f* serving as a holder is a substantial case that accommodates a part of the solid lubricant 15*b*, the mount 15*e*, and the compression spring 15*c*. The mount 15*e* is slidable over interior walls of the guide 15*f*. One end of the compression spring 15*c* is anchored to an interior bottom of the guide 15*f*; another end of the compression spring 15*c* is anchored to the mount 15*e*. As the solid lubricant 15*b* is consumed, the compression spring 15*c* biasing the solid lubricant 15*b* against the lubricant application roller 15*a* moves and slides the mount 15*e* over the interior walls of the guide 15*f*. Accordingly, the solid lubricant 15*b* is pressed against the lubricant application roller 15*a*. Thus, the lubricant supplier 15 serves as an image carrier surface treatment device disposed opposite the photoconductive drum 11 serving as an image carrier to perform surface treatment of the photoconductive drum 11, increasing the lifespan of the photoconductive drum 11. As shown in FIG. 4, the lubricant application roller 15*a* is rotatably supported by ball bearings 15*m* serving as a rolling-element bearing. A detailed description of the ball bearing 15*m* is deferred.

With reference to FIG. 2, a detailed description is now given of the image forming processes described above.

The development roller 13*a* rotates clockwise in FIG. 2 in a rotation direction R5. As the primary conveyance screw 13*b* and the secondary conveyance screw 13*c* disposed opposite the primary conveyance screw 13*b* via the partition rotate, they circulate a developer G accommodated inside the development device 13 in a longitudinal direction of the primary conveyance screw 13*b* and the secondary conveyance screw 13*c* parallel to an axial direction thereof while the developer G is agitated and mixed with fresh toner particles T supplied from a toner supplier 30 through a toner inlet.

The toner particles T attracted to carrier particles C by frictional charging, together with the carrier particles C, move onto the development roller 13*a*. As the development roller 13*a* rotates in the rotation direction R5, the developer G containing the toner particles T and the carrier particles C carried by the development roller 13*a* reaches the doctor blade 13*d*. After the doctor blade 13*d* adjusts an amount of the developer G carried by the development roller 13*a*, the developer G reaches the development position where the development roller 13*a* is disposed opposite the photoconductive drum 11.

At the development position, the toner particles T contained in the developer G adhere to the electrostatic latent image formed on the outer circumferential surface of the photoconductive drum 11. For example, an electrostatic latent image potential, that is, an exposure potential, created by a laser beam L irradiating the photoconductive drum 11 and a development bias applied to the development roller 13*a* produce a potential difference, that is, a development potential, that creates an electric field. The electric field causes the toner particles T to adhere to the electrostatic latent image formed on the photoconductive drum 11, thus visualizing the electrostatic latent image into a toner image.

The toner particles T adhered to the photoconductive drum 11 during the development process are mostly primarily transferred onto the intermediate transfer belt 17. Conversely, residual toner particles T failed to be transferred onto the intermediate transfer belt 17 and therefore remaining on the photoconductive drum 11 are removed and collected by the cleaning blade 14*a* and the cleaning roller 14*b* into the cleaner 14. Thereafter, the outer circumferential surface of the photoconductive drum 11 passes through the lubricant supplier 15 and the discharger successively. Thus, a series of image forming processes performed on the photoconductive drum 11 is completed.

A detailed description is now given of a construction of the toner supplier 30.

The toner supplier 30 located inside the image forming apparatus 1 depicted in FIG. 1 includes a toner bottle 31 detachably attached to the image forming apparatus 1 for replacement and a toner hopper 32 that drives and rotates the toner bottle 31 while supporting it to replenish the development device 13 with fresh toner particles T. For example, the toner bottle 31 connected to the development device 13 of the process cartridge 10Y shown in FIG. 2 contains fresh yellow toner particles T. An inner circumferential surface of the toner bottle 31 mounts helical projections.

As the toner particles T contained in the development device 13 are consumed, fresh toner particles T contained in the toner bottle 31 are supplied into the development device 13 through the toner inlet as appropriate. Consumption of the toner particles T contained in the development device 13 is detected by a reflective photo sensor disposed opposite the photoconductive drum 11 or a magnetic sensor situated below the secondary conveyance screw 13*c* of the development device 13 directly or indirectly.

A description is provided of a configuration and an operation of the lubricant supplier 15 that supplies and applies the lubricant to the photoconductive drum 11.

As described above with reference to FIGS. 2 and 3, the lubricant supplier 15 serving as an image carrier surface treatment device includes the lubricant application roller 15*a* serving as a roller that rotates in the rotation direction R4 while contacting the outer circumferential surface of the photoconductive drum 11 serving as an image carrier.

Figure 5:
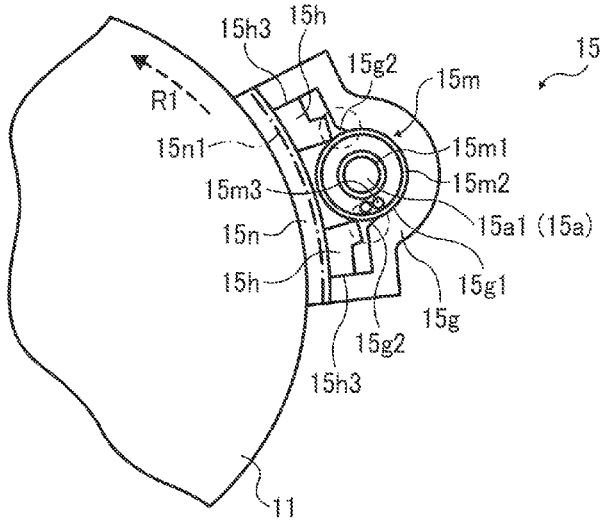
FIG. 5 is a vertical sectional view of the lubricant supplier shown in FIG. 4 illustrating a ball bearing incorporated therein.

With reference to FIGS. 4 and 5, a detailed description is now given of a configuration of the ball bearing 15*m*.

FIG. 5 is a vertical sectional view of the lubricant supplier 15 illustrating the ball bearing 15*m*. As shown in FIG. 4, the ball bearing 15*m* serving as a rolling-element bearing is press-fitted onto the shaft 15*a*1 (e.g., a metal core) of the lubricant application roller 15*a* projecting outward from each lateral end of the lubricant application roller 15*a* in an axial direction parallel to a width direction thereof. The lubricant application roller 15*a* is supported and positioned inside the lubricant supplier 15 via the ball bearings 15*m*.

The ball bearings 15*m* absorb vibration created by the lubricant application roller 15*a* as it rotates and slides over the solid lubricant 15*b* and the photoconductive drum 11. As shown in FIG. 5, as vibration is transmitted from the shaft 15*a*1 of the lubricant application roller 15*a* to an inner race 15*m*1 of the ball bearing 15*m*, most of vibration energy is converted into rotational energy by balls 15*m*3 interposed between the inner race 15*m*1 and an outer race 15*m*2 of the ball bearing 15*m* such that the balls 15*m*3 point-contacting and rolling between the inner race 15*m*1 and the outer race 15*m*2 of the ball bearing 15*m* interrupt vibration transmission to the outer race 15*m*2 of the ball bearing 15*m*. Accordingly, a body (e.g., a frame 15*g* and a bearing support 15*h*, a description of which is deferred) of the lubricant supplier 15 contacted by the outer race 15*m*2 of the ball bearing 15*m* barely vibrates and therefore vibration is not transmitted to the photoconductive drum 11. Consequently, the lubricant supplier 15 reduces formation of a faulty toner image such as a streaky toner image that may be periodically produced by vibration transmitted from the lubricant application roller 15*a* to the photoconductive drum 11.

According to this example embodiment, the ball bearing 15*m* is used as a rolling-element bearing that supports the lubricant application roller 15*a*. Alternatively, a roller bearing, a needle bearing, a tapered roller bearing, a spherical roller bearing, and the like may be used as a rolling-element bearing that supports the lubricant application roller 15*a*. The ball bearing 15*m* has an interior structure in which the balls 15*m*3 contact the inner race 15*m*1 and the outer race 15*m*2 in a decreased area, facilitating interruption of vibration transmission from the inner race 15*m*1 to the outer race 15*m*2.

With reference to FIGS. 4 and 5, a detailed description is now given of a configuration of the frame 15*g* and the bearing support 15*h*.

As shown in FIG. 5, the bearing support 15*h* is situated in proximity to the photoconductive drum 11 such that the bearing support 15*h* is detachable from and attachable to the frame 15*g* of the lubricant supplier 15. For example, the frame 15*g* is made of resin and molded with a frame constituting a casing of the process cartridge 10Y. As shown in FIG. 4, the bearing support 15*h*, made of resin, and the frame 15*g* sandwich and hold the ball bearing 15*m*. For example, as shown in FIG. 5, the frame 15*g* includes an arc 15*g*1 having a substantial U-shape in cross-section corresponding to the curve of the outer race 15*m*2 of the ball bearing 15*m* so as to fit over and support the ball bearing 15*m*. On the other hand, as shown in FIG. 4, the bearing support 15*h* includes a recess 15*h*2 that linearly contacts the outer race 15*m*2 of the ball bearing 15*m* so as to support the ball bearing 15*m*. As shown in FIG. 5, the bearing support 15*h* further includes outboard portions 15*h*3 that engage the frame 15*g*. While the ball bearing 15*m* engages the arc 15*g*1 of the frame 15*g*, the bearing support 15*h* is inserted into and engaged with the frame 15*g* to come into contact with the ball bearing 15*m*. Thus, the ball bearing 15*m* is supported and positioned inside the lubricant supplier 15. Accordingly, the lubricant application roller 15*a* is positioned with respect to the frame 15*g* relatively precisely. Additionally, the lubricant application roller 15*a* is assembled in the frame 15*g* of the lubricant supplier 15 relatively readily.

As shown in FIG. 5, bottom ends 15*g*2 of the arc 15*g*1 of the frame 15*g* indicated by the dotted circles define boundaries between the arc 15*g*1 and the ball bearing 15*m* that engages the arc 15*g*1, respectively. Each bottom end 15*g*2 of the arc 15*g*1 is chamfered into a C-shaped or round face. The chamfered bottom ends 15*g*2 of the arc 15*g*1 of the frame 15*g* facilitate attachment of the ball bearing 15*m* to the frame 15*g*.

As shown in FIG. 5, a seal 15*n* made of an elastic material such as polyurethane foam is interposed between the bearing support 15*h* and the photoconductive drum 11 to seal a gap between the bearing support 15*h* and the photoconductive drum 11. The seal 15*n* prevents the lubricant from scattering to an outside of the lubricant supplier 15 where the lubricant should not be supplied. The seal 15*n* also serves as a cushion that reduces transmission of vibration from the lubricant supplier 15 to the photoconductive drum 11, thus suppressing formation of a streaky toner image precisely. In order to decrease resistance between the seal 15*n* and the photoconductive drum 11 sliding over the seal 15*n*, a slide surface of the seal 15*n* over which the photoconductive drum 11 slides may be applied with a low frictional coating or adhered with a low frictional material such as Mylar®.

As shown in FIG. 5, the seal 15*n* includes an adhesive face 15*n*1 indicated by the alternate long and short dashed lines that is adhered to the bearing support 15*h* and disposed opposite the photoconductive drum 11. The bearing support 15*h* prohibits the ball bearing 15*m* disposed opposite the adhesive face 15*n*1 of the seal 15*n* from moving toward the adhesive face 15*n*1 of the seal 15*n* and the photoconductive drum 11. Accordingly, the ball bearing 15*m* does not press and deform the seal 15*n* and therefore does not obstruct sealing of the seal 15*n*.

Figure 6:
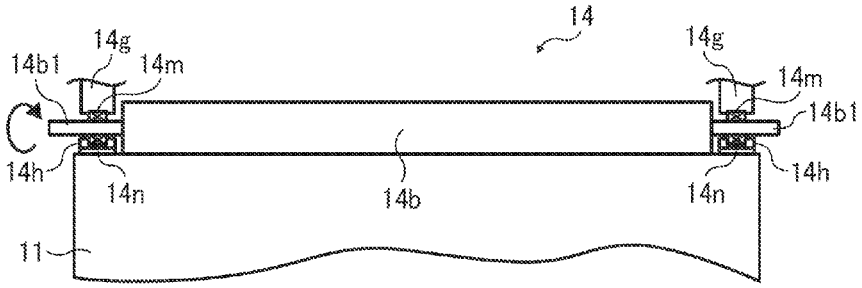
FIG. 6 is a horizontal sectional view of the cleaner shown in FIG. 3.

The above describes the construction of the lubricant supplier 15 that serves as an image carrier surface treatment device. Additionally, the cleaner 14 depicted in FIG. 3 also has a construction shown in FIG. 6 that is equivalent to the construction of the lubricant supplier 15 shown in FIGS. 4 and 5, thus serving as an image carrier surface treatment device. FIG. 6 is a horizontal sectional view of the cleaner 14. As shown in FIG. 6, like the lubricant application roller 15*a* depicted in FIG. 4, the cleaning roller 14*b* serving as a roller mounts the shaft 14*b*1 at each lateral end of the cleaning roller 14*b* in an axial direction thereof. A ball bearing 14*m* serving as a rolling-element bearing is press-fitted onto the shaft 14*b*1 of the cleaning roller 14*b* that projects outward from each lateral end of the cleaning roller 14*b* in the axial direction thereof. The cleaning roller 14*b* is supported and positioned inside the cleaner 14 through the ball bearings 14*m*. Like the lubricant supplier 15, the cleaner 14 further includes a frame 14*g*, a bearing support 14*h*, and a seal 14*n* that are equivalent to the frame 15*g*, the bearing support 15*h*, and the seal 15*n* of the lubricant supplier 15 depicted in FIG. 4. Hence, the cleaner 14 achieves advantages equivalent to those of the lubricant supplier 15 described above.

As shown in FIGS. 4 and 6, an image carrier surface treatment device (e.g., the lubricant supplier 15 and the cleaner 14) includes a roller (e.g., the lubricant application roller 15*a* and the cleaning roller 14*b*) that slides over an image carrier (e.g., the photoconductive drum 11) and mounts a shaft (e.g., the shafts 15*a*1 and 14*b*1) at each lateral end of the roller in an axial direction thereof. A rolling-element bearing (e.g., the ball bearings 15*m* and 14*m*) is fitted on the shaft so that the roller is supported and positioned inside the image carrier surface treatment device through the rolling-element bearing. Accordingly, vibration of the roller is not transmitted to the image carrier, reducing formation of a faulty toner image such as a streaky toner image caused by vibration. Since vibration is created by the roller (e.g., the lubricant application roller 15*a* and the cleaning roller 14*b*), not by the image carrier (e.g., the photoconductive drum 11), if the rolling-element bearings are fitted on a shaft of the photoconductive drum 11, the rolling-element bearings may not prevent transmission of vibration from the roller to the image carrier.

As shown in FIG. 2, the cleaner 14, the lubricant supplier 15, the photoconductive drum 11, the charging roller 12*a*, and the development device 13 are formed into a compact process cartridge (e.g., the process cartridges 10Y, 10M, 10C, and 10K) serving as an image forming device that forms a toner image, downsizing the process cartridge and facilitating maintenance of the process cartridge. Alternatively, the cleaner 14 and the lubricant supplier 15 may not constitute a process cartridge. For example, each of the cleaner 14 and the lubricant supplier 15 may be detachably attached to the image forming apparatus 1 depicted in FIG. 1 individually for replacement. In this case also, the advantages of the cleaner 14 and the lubricant supplier 15 described above are achieved. It is to be noted that a process cartridge defines a unit detachably attachable to the image forming apparatus 1 and constructed of an image carrier (e.g., the photoconductive drum 11) and at least one of a charger (e.g., the charging roller 12*a*) that charges the image carrier, a development device (e.g., the development device 13) that develops an electrostatic latent image formed on the image carrier into a visible toner image, and a cleaner (e.g., the cleaner 14) that cleans the image carrier.

According to the above-described example embodiments, the image forming apparatus 1 is installed with the development device 13 that employs a two-component development method using a two-component developer containing toner particles and carrier particles. Alternatively, the image forming apparatus 1 may be installed with a development device that employs a one-component development method using a one-component developer containing toner particles.

Further, according to the above-described example embodiments, the lubricant supplier 15 disposed opposite the photoconductive drum 11 supplies a lubricant to the photoconductive drum 11 serving as an image carrier. Alternatively, the lubricant supplier 15 may be disposed opposite a photoconductive belt serving as an image carrier to supply a lubricant to the photoconductive belt. Additionally, the lubricant supplier 15 may be disposed opposite the intermediate transfer belt 17 depicted in FIG. 1 that serves as an image carrier to supply a lubricant to the intermediate transfer belt 17. Further, the lubricant supplier 15 may be disposed opposite the intermediate transfer belt cleaner 19 depicted in FIG. 1 to supply a lubricant to the intermediate transfer belt cleaner 19.

As shown in FIG. 3, the lubricant application roller 15*a* includes the shaft 15*a*1 and the elastic foam layer 15*a*2 coating the shaft 15*a*1. Alternatively, the lubricant application roller 15*a* may include the shaft 15*a*1 and straight or looped bristles implanted over an outer circumference of the shaft 15*a*1. In this case, the bristles are made of resin fiber such as polyester, nylon, rayon, acryl, vinylon, vinyl chloride, and the like. Alternatively, the bristles may be made of conductive resin added with conductivity impartation agent such as carbon. The bristles may have a length in a range of from about 0.2 mm to about 20.0 mm and a density in a range of from about 20,000 F/inch$^2$ to about 100,000 F/inch$^2$. The ball bearings 15*m* depicted in FIG. 4 may also support the lubricant application roller 15*a* incorporating such bristles to achieve advantages equivalent to the advantages described above.

According to the example embodiments described above, the lubricant application roller 15*a* and the cleaning roller 14*b* are positioned inside the lubricant supplier 15 and the cleaner 14 through the ball bearings 15*m* and 14*m*, respectively. Alternatively, the lubricant application roller 15*a* may be positioned inside the lubricant supplier 15 through the ball bearings 15*m* and the cleaning roller 14*b* may not be positioned inside the cleaner 14 through the ball bearings 14*m*. For example, as the lubricant application roller 15*a* slides over the solid lubricant 15*b* and the photoconductive drum 11, the lubricant application roller 15*a* is subject to substantial vibration. To address this circumstance, the ball bearings 15*m* anchored to the frame 15*g* of the lubricant supplier 15 supports the lubricant application roller 15*a* to reduce transmission of vibration from the lubricant application roller 15*a* to the photoconductive drum 11, thus suppressing formation of a faulty toner image that may be caused by vibration of the photoconductive drum 11.

According to the example embodiments described above, the ball bearings 15*m* and 14*m* support the lubricant application roller 15*a* and the cleaning roller 14*b*, respectively. Alternatively, since the charging roller 12*a* depicted in FIG. 2 also slides over the photoconductive drum 11, ball bearings serving as rolling-element bearings that are equivalent to the ball bearings 15*m* and 14*m* may support the charging roller 12*a* in contact with the photoconductive drum 11 so as to position the charging roller 12*a* inside the charger 12 serving as an image carrier surface treatment device disposed opposite the photoconductive drum 11 serving as an image carrier to perform surface treatment of the photoconductive drum 11, thus increasing the lifespan of the photoconductive drum 11.

With reference to FIGS. 4 and 6, a description is provided of advantages of the lubricant supplier 15 and the cleaner 14.

An image carrier surface treatment device (e.g., the lubricant supplier 15 and the cleaner 14) is disposed opposite an image carrier (e.g., the photoconductive drum 11) rotatable in a first rotation direction (e.g., the rotation direction R1) and carrying a toner image. The image carrier surface treatment device includes a roller (e.g., the lubricant application roller 15*a* and the cleaning roller 14*b*) in contact with the outer circumferential surface of the image carrier and rotatable in a second rotation direction (e.g., the rotation directions R4 and R3) to slide over the image carrier and a rolling-element bearing (e.g., the ball bearings 15*m* and 14*m*) fitted onto a shaft (e.g., the shafts 15*a*1 and 14*b*1) projecting from each lateral end of the roller in the axial direction thereof. The roller is positioned inside the image carrier surface treatment device through each rolling-element bearing.

Accordingly, the rolling-element bearings supporting the roller reduce transmission of vibration from the roller to the image carrier, suppressing formation of a faulty toner image such as a streaky toner image that may appear due to vibration from the roller. The image carrier surface treatment device is installable in a process cartridge (e.g., the process cartridges 10Y, 10M, 10C, and 10K) that is detachably attachable to the image forming apparatus 1.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. An image carrier surface treatment device opposite an image carrier rotatable in a first rotation direction and carrying a toner image, the image carrier surface treatment device comprising:

a roller rotatable in a second rotation direction and in contact with an outer circumferential surface of the image carrier, the roller including a shaft projecting from each lateral end in an axial direction thereof;

a rolling-element bearing on the shaft of the roller and configured to support and position the roller inside the image carrier surface treatment device;

a bearing support opposite the image carrier and sandwiching the rolling-element bearing in the first rotation direction; and a seal sandwiched between the bearing support and the image carrier.

2. The image carrier surface treatment device according to claim 1, wherein the seal includes an adhesive face adhered to the bearing support and disposed opposite the rolling-element bearing, and wherein the bearing support sandwiching the rolling-element bearing prohibits the rolling-element bearing from moving toward the adhesive face of the seal and the image carrier.

3. The image carrier surface treatment device according to claim 1, further comprising a frame contacting the rolling-element bearing and the bearing support.

4. The image carrier surface treatment device according to claim 3, wherein the bearing support is detachably attached to the frame.

5. The image carrier surface treatment device according to claim 3, wherein the bearing support includes a plurality of outboard portions to engage the frame.

6. The image carrier surface treatment device according to claim 3, wherein the rolling-element bearing includes a ball bearing including:

an inner race contacting the shaft of the roller; and an outer race contacting the bearing support and the frame.

7. The image carrier surface treatment device according to claim 6, wherein the bearing support includes a recess linearly contacting the outer race of the ball bearing.

8. The image carrier surface treatment device according to claim 6, wherein the frame includes an arc, having a substantial U-shape in cross-section corresponding to a curve of the outer race of the ball bearing, to support the ball bearing.

9. The image carrier surface treatment device according to claim 8, wherein the arc of the frame includes a plurality of chamfered bottom ends defining boundaries between the arc and the ball bearing that engages the arc, respectively.

10. The image carrier surface treatment device according to claim 1, further comprising:

a solid lubricant contacting the roller; and a biasing member to bias the solid lubricant against the roller, wherein the roller includes a lubricant application roller to slide over the solid lubricant and the image carrier while rotating in the second rotation direction to scrape a lubricant off the solid lubricant and apply the scraped lubricant onto the image carrier.

11. The image carrier surface treatment device according to claim 1, further comprising a cleaning blade contacting and cleaning the image carrier, wherein the roller includes a cleaning roller to slide over the image carrier while rotating in the second rotation direction to clean the image carrier.

12. A process cartridge detachably attachable to an image forming apparatus, the process cartridge comprising:

an image carrier rotatable in a first rotation direction and configured to carry a toner image; and an image carrier surface treatment device opposite the image carrier and including:

a roller rotatable in a second rotation direction and in contact with an outer circumferential surface of the image carrier, the roller including a shaft projecting from each lateral end in an axial direction thereof;

a rolling-element bearing on the shaft of the roller and configured to support and position the roller inside the image carrier surface treatment device;

a bearing support opposite the image carrier and sandwiching the rolling-element bearing in the first rotation direction; and a seal sandwiched between the bearing support and the image carrier.

13. An image forming apparatus comprising:

an image carrier rotatable in a first rotation direction and configured to carry a toner image; and an image carrier surface treatment device opposite the image carrier and including:

a roller rotatable in a second rotation direction and in contact with an outer circumferential surface of the image carrier, the roller including a shaft projecting from each lateral end of the roller in an axial direction thereof;

a rolling-element bearing fitted on the shaft of the roller and configured to support and position the roller inside the image carrier surface treatment device;

a bearing support opposite the image carrier and sandwiching the rolling-element bearing in the first rotation direction; and a seal sandwiched between the bearing support and the image carrier.

* * * * *